US007399048B2

(12) United States Patent
Inoue

(10) Patent No.: US 7,399,048 B2
(45) Date of Patent: Jul. 15, 2008

(54) INKJET RECORDING APPARATUS AND METHOD FOR DETECTING DISCHARGE DEFECTS

(75) Inventor: Hiroshi Inoue, Kaiseimachi (JP)

(73) Assignee: Fujifilm Corporation, Tokyo (JP)

( * ) Notice: Subject to any disclaimer, the term of this patent is extended or adjusted under 35 U.S.C. 154(b) by 265 days.

(21) Appl. No.: 10/936,677

(22) Filed: Sep. 9, 2004

(65) Prior Publication Data

US 2005/0052488 A1 Mar. 10, 2005

(30) Foreign Application Priority Data

Sep. 10, 2003 (JP) ..... 2003-318548

(51) Int. Cl.
*B41J 29/393* (2006.01)

(52) U.S. Cl. ..... 347/19; 347/9; 347/16

(58) Field of Classification Search ..... 347/2, 347/19, 23, 107; 399/49
See application file for complete search history.

(56) References Cited

U.S. PATENT DOCUMENTS 6,145,981 A * 11/2000 Akahira et al. ..... 347/107
6,454,382 B1 * 9/2002 Galentovski ..... 347/19
6,804,479 B2 * 10/2004 Kimura ..... 399/49
2001/0052913 A1 12/2001 Matsumoto et al.

FOREIGN PATENT DOCUMENTS

| | | | |
|---|---|---|---|
| JP | 04-039041 | A | 2/1992 |
| JP | 6-24008 | A | 2/1994 |
| JP | 06-340063 | A | 12/1994 |
| JP | 9-101410 | A | 4/1997 |
| JP | 2000-158640 | A | 6/2000 |
| JP | 2001-315318 | A | 11/2001 |
| JP | 2002-059565 | A | 2/2002 |
| JP | 2003-94732 | A | 4/2003 |
| JP | 2004-009474 | A | 1/2004 |
| JP | 2005-035102 | A | 2/2005 |

* cited by examiner

*Primary Examiner*—Lam S Nguyen
(74) *Attorney, Agent, or Firm*—Birch, Stewart, Kolasch & Birch, LLP

(57) ABSTRACT

The inkjet recording apparatus comprises: a print head which discharges ink droplets; a conveyance device which relatively moves a printing medium in a printing medium conveyance direction with respect to the print head, the conveyance device having a holding conveyance member which holds the printing medium and conveys the printing medium; a test printing control device which controls printing of a test image to the holding conveyance member; and a reading device which reads the test image printed on the holding conveyance member with the test printing control device.

9 Claims, 13 Drawing Sheets

INKJET RECORDING APPARATUS AND METHOD FOR DETECTING DISCHARGE DEFECTS

This Non-provisional application claims priority under 35 U.S.C. §119(a) on Patent Application No(s). 2003-318548 filed in Japan on Sep. 10, 2003, the entire contents of which are hereby incorporated by reference.

BACKGROUND OF THE INVENTION

1. Field of the Invention

The present invention relates to an inkjet recording apparatus and a method for detecting discharge defects, and more particularly to technology for detecting discharge defects in nozzles that discharge ink droplets.

2. Description of the Related Art

In recent years, inkjet recording apparatuses (inkjet printers) serving as recording apparatuses that print/record images or the like taken by digital still camera have become widely distributed. Inkjet recording apparatuses have a plurality of recording elements in the head, the recording head is moved to scan the recording medium while ink droplets are discharged from the recording elements to the recording medium, the recording medium is conveyed by a single line when one line of image has been recorded on recording paper, and an image is formed on the recording paper by repeating these steps.

There are inkjet printers that use a short serial head and record images while causing the head to scan in the width direction of the recording medium, or those that use a line head in which recording elements are arrayed across the entire range of one side of the recording medium. In printers in which a line head is used, images can be recorded on the entire surface of the recording medium by scanning the recording medium in the direction orthogonal to the array direction of the recording elements. In printers in which a line head is used, a carriage or another conveyance system for moving the short head back and forth is unnecessary, and complex scanning control for the carriage movement and recording medium is not required. Also, the recording medium alone moves, so recording speed can be increased in comparison with printers in which a serial head is used.

In inkjet printers, some of the large number of nozzles sometimes no longer discharge ink for some reason, and the amount of ink discharged (the size of the dot deposited onto the recording paper) or the flight direction (droplet deposition position) becomes defective. The defective discharge of such nozzles causes the quality of recorded images to be degraded, so a countermeasure thereto is required.

Conventionally, known methods for detecting discharge defects in nozzles include a method for measuring a printed test pattern, a method for measuring an actual print job (the printed result of a target image that actually requires printing output), and a method for measuring the characteristics (resistance and other physical properties) during discharge inside the head.

In the inkjet recording apparatus and inkjet recording method disclosed in Japanese Patent Application Publication No. 2001-315318, non-discharge nozzles are identified by detecting drive voltage changes via the ink on the print head substrate by means of a detection electrode disposed inside the recording head.

The inkjet recording apparatus cited in Japanese Patent Application Publication No. 6-24008 forms a continuous line composed of all the nozzles of one head in a position in which a plurality of heads do not interfere with each other, and optically or electrically detects the existence of intermittent portions in the line thereof.

In the method and device for manufacturing a color filter cited in Japanese Patent Application Publication No. 9-101410, detection is performed based on the state when ink discharged from an inkjet head passes through a laser beam.

Nevertheless, the method for measuring a printed test pattern requires that a special purpose test pattern be printed separately from a target image that is actually to be printed. With a simple pattern, there is a drawback in that the results are affected by measurement position errors, and it is difficult to detect discharge-defective nozzles. Furthermore, there is a drawback in that the results are affected by the output variability of the line sensors that image the test pattern.

In the case of the method for measuring an actual print job, there is a drawback in that it is difficult to determine whether the actual print job is the original image content or whether it is an image defect due to a defective nozzle, and it is difficult to accurately identify discharge-defective nozzles due to the effect of measurement position errors because the actual print job, which is the measurement object, is commonly a complex image. Also, in the same manner as in the above test pattern, the results are affected by variability in the line sensors.

In the inkjet recording apparatus and inkjet recording method disclosed in Japanese Patent Application No. 2001-315318, non-discharge due to bubbles becoming intermixed in the nozzle can be detected, but non-discharge due to adhering foreign matter or other causes cannot be detected.

The inkjet recording apparatus cited in Japanese Patent Application Publication No. 6-24008 requires trial discharge paper, and paper is wasted.

In the method and device for manufacturing a color filter cited in Japanese Patent Application Publication No. 9-101410, time is required for detection when the number of nozzles has increased. Also, light-emitting diodes and photodetectors must be disposed under the nozzle, and a long head must be provided with a standby mechanism.

SUMMARY OF THE INVENTION

The present invention has been contrived in view of such circumstances, and an object thereof is to provide an inkjet recording apparatus and a method for detecting discharge defects that can detect discharge-defective nozzles without a loss of productivity.

In order to attain the above-described object, the present invention is directed to an inkjet recording apparatus, comprising: a print head which discharges ink droplets; a conveyance device which relatively moves a printing medium in a printing medium conveyance direction with respect to the print head, the conveyance device having a holding conveyance member which holds the printing medium and conveys the printing medium; a test printing control device which controls printing of a test image to the holding conveyance member; and a reading device which reads the test image printed on the holding conveyance member with the test printing control device.

In accordance with the present invention, a configuration is adopted whereby a test pattern is printed onto the holding conveyance member used for conveying the printing medium inside the conveyance device, and the test image is read by the reading device, so a printing medium for the test image is not required.

The print head may be a full-line print head in which nozzles are disposed across the entire width of the printable area in a direction that is substantially orthogonal to the printing medium conveyance direction may be used as, or a shuttle-scan print head in which a short print head is caused to discharge ink droplets as it moves in the direction that is substantially orthogonal to the paper conveyance direction.

A conveyor belt or drum may be used as a holding conveyance member.

The test image includes images and characters or the like that are favorable for detecting discharge-defective nozzles, and may be composed of a plurality of colors. Also, control may be performed so as to print a test image for each color.

The test image may be an image printed from all of the nozzles, or may be an image printed from a portion of the nozzles. The aspect for selecting a portion of the nozzles may be one in which nozzles that are used infrequently are selected, or one in which nozzles that previously have had discharge defects may be selected.

The printing medium should be held in place by the holding conveyance member in the printing area, which is the area in which at least ink droplets are discharged, and should be held in place so as to assure a predetermined planarity in the printing area.

Line sensors or area sensors may be used as the reading device. Also possible are a monochrome sensor or a sensor that handles a plurality of colors. Also possible is an aspect in which a laser beam is directed to the surface and the reflected light thereof is read.

In the present specification, the term "printing" expresses the concept of not only the formation of characters, but also the formation of images with a broad meaning that includes characters.

The term "printing medium" refers to a medium (medium on which an image is formed) that is printed on by a recording head. The medium includes continuous paper, cut paper, seal paper, OHP sheets, and other resin sheets, as well as film, cloth, and various other media without regard to materials or shapes.

The term "conveyance device" includes an aspect in which the printing medium is conveyed with respect to a stationary (fixed) recording head, an aspect in which the recording head is moved with respect to a stationary printing medium, or an aspect in which both the recording head and the printing medium are moved.

In accordance with an aspect of the present invention, the holding conveyance member has a predetermined area for printing the test image; and the test printing control device performs control for printing the test image in the predetermined area.

For example, when the printing medium is held in place on the holding conveyance member by air suction, the pitch of the air suction holes in the printing medium conveyance direction may be configured such that an area that is wider in comparison with other areas is provided, and so that the test image is printed in this area.

In accordance with this aspect, the predetermined area contains an area in which a test image is printed, so the medium is firmly held and adequately conveyed on the holding conveyance member.

In accordance with another aspect of the present invention, the holding conveyance member has a plurality of predetermined areas for printing the test image; the plurality of predetermined areas are disposed with an interval matched to a size of the printing medium that has a high frequency of use in the conveyance direction of the printing medium; and the test printing control device performs control for printing the test image in the plurality of predetermined areas.

In accordance with this aspect, the intervals between printing media are smaller, higher productivity is achieved, and conveyance of large-size printing media is improved.

For example, 10 sheets of L-size printing paper with a width (in the direction substantially orthogonal to the conveyance direction) of 127 mm and a length (in the conveyance direction) of 89 mm are arranged at 5 mm intervals, and a test printing area with a length of 20 mm is provided every 10 sheets. Thus, the test printing area is set with a 935 mm interval, allowing discharge defects to be frequently checked. L-size printing paper is normally arranged with a narrow interval of 5 mm in length, so the productivity of L-size printing paper is increased.

The printing media interval may be adjusted to the size of the printing medium with the highest frequency of use, or may be adjusted to the lowest common multiple between the printing medium with the highest frequency of use and the printing medium with the next highest frequency of use. Also, the interval of the area in which the test image is printed may be selected so that a plurality of printing media can be set in place.

In accordance with yet another aspect of the present invention, the holding conveyance member comprises a position adjustment device which relatively adjusts positions of a plurality of printing media that are continuously conveyed by the conveyance device and the predetermined area for printing the test image so that the predetermined area for printing the test image is disposed between the plurality of printing media.

The configuration may be one in which printing media are not placed in the area for printing the test image, or one in which printing media are detected when placed in the area for printing the test image, and control is performed so that the test image is not printed when printing media are placed in the area for printing the test image. This is particularly effective when a full-line line head is used.

Preferably, a detector (sensor) is provided in at least one of the conveyance device and a driving system for driving the conveyance device, and hence the position adjustment device can control the relative positions of the printing medium and the predetermined area for printing the test image using signals obtained from the sensor, or the position adjustment device can control the relative positions of the printing medium and the predetermined area for printing the test image on the basis of a control signal from the driving system (for example, an operate command signal to the motor of the driving system).

In accordance with yet another aspect of the present invention, the test printing control device performs control so that the test image is printed in an area between actual images.

In accordance with this aspect, a test image can be printed between an actual image and the next actual image, so productivity is not lost. An actual image includes the printed result of printed image data.

In accordance with another aspect of the present invention, the inkjet recording apparatus further comprises a detection device which detects a discharge-defective nozzle according to the test image read by the reading device.

In accordance with this aspect, the configuration is such that discharge-defective nozzles are detected from the read results of a test image, so when discharge-defective nozzles are detected, correction can be made to the image with other nozzles, restorative action can be performed on the discharge-defective nozzles, and the image quality can be improved.

The detection device can detect the presence of deposited ink, the deposition diameter, and the like, and determine discharge-defective nozzles from the presence of a discharge and the amount of ink discharge, respectively.

Furthermore, in accordance with another aspect of the present invention, at least the predetermined area for printing the test image of the holding conveyance member has a color whereby an ink color is easily determined.

In accordance with this aspect, the ink droplets and the holding conveyance member are easily distinguished from each other, and the read accuracy is improved.

Cyan, magenta, yellow, and black are commonly used as the ink colors. Colors with wavelength ranges that make these colors easy to distinguish may be used, and a difference in brightness between these colors may also be used. In other words, the sensors used for the read device should be able to reliably recognize ink droplets.

The holding conveyance member may be composed of a plurality of colors corresponding to the print colors and not only to just one color, and may be transparent or semitransparent. When the holding conveyance member is transparent or semitransparent, it is also possible to read an image resulting from the transmitted light.

The term "color" used herein also refers to black and white (monochrome).

In accordance with another aspect of the present invention, wherein at least the predetermined area for printing the test image of the holding conveyance member is composed of a material in which deposition characteristics of the ink droplets are stable.

In accordance with this aspect, the deposition characteristics of the ink droplets when printing the test image can be made stable, and the read accuracy is improved. Furthermore, the holding conveyance member is preferably a material that is easy to clean.

With consideration for preventing coalescence of the ink droplets and the ease of cleaning the holding conveyance member, the holding conveyance member material is preferably a material on which the contact angle is about 40°. The holding conveyance member material is more preferably a material on which the contact angle is about 100°. The contact angle refers to a contact angle established in a fixed length of time after ink droplets have been deposited to a predetermined printing medium (i.e., the holding conveyance member here), and is the angle between the holding conveyance member and the ink droplet surface in the contact portion (wetted portion) between the ink holding conveyance member and the ink droplet.

In accordance with yet another aspect of the present invention, the inkjet recording apparatus further comprises a cleaning device which cleans the holding conveyance member, the cleaning device being disposed on a downstream side of the reading device in the printing medium conveyance direction.

In accordance with this aspect, after a test image is read by the reading means, the holding conveyance member is cleaned without sullying the printing medium, and subsequent test printing is possible.

Aspects of the cleaning device include an aspect of wiping with a roller or a blade or the like (stripping), an aspect of wetting the belt with cleaning fluid (solvent) and removing (dissolving) ink and other unwanted material, and other aspects.

The cleaning device can be simplified when made to double as an excess ink cleaning member for entire screen printing (image printing without margins).

In accordance with yet another aspect of the present invention, the test printing control device performs control to deposit the ink droplets of a plurality of colors to the same deposition point to make a mixed-color dot composed of the plurality of colors; and the reading device reads dot information for each color from the mixed-color dot.

In accordance with this aspect, the configuration is one in which information for a plurality of colors is read from a single dot, so the test printing area can be set to a minimum surface area, and conveyance performance can be improved.

A color sensor may be used as the reading device, and a color filter for each color may be provided to each sensor. An RGB color filter may be provided to the CMYK inks, for example.

Also, the present invention provides a method invention for achieving the above object. In other words, the present invention is also directed to a method which detects a discharge defect in an inkjet recording apparatus comprising a print head which discharges ink droplets, and a conveyance device which relatively moves a printing medium in a printing medium conveyance direction with respect to the print head, the conveyance device having a holding conveyance member which holds the printing medium and conveys the printing medium, the method comprising: a test printing step of printing a test image on the holding conveyance member from the print head; a reading step of reading with a reading device the test image deposited to the holding conveyance member in the test printing step; and a detection step of detecting a discharge-defective nozzle according to the test image read in the reading step.

A preferred aspect is one that is provided with a nozzle restorative device for performing restorative actions for detected discharge-defective nozzles, and/or a correction device for performing corrections to the printed image produced through the use of the discharge-defective nozzles.

In accordance with the present invention, a configuration is adopted in which a test image is printed on the holding conveyance member having a conveyance device, so a printing medium (paper) for printing the test image is not required and the test image is printed between images, so allowing productivity to be maintained. When discharge-defective nozzles are detected, predetermined nozzle restorative actions and predetermined image corrections can be performed.

Also, discharge-defective nozzles can be detected from the read results by the reading device, and the test image printed on the holding conveyance member can be cleaned after reading by the cleaning device for cleaning the holding conveyance member.

The holding conveyance member is composed of a material whereby the deposition characteristics of the ink droplets are made stable, and has a color whereby the colors of the ink droplets are easy to distinguish, so the deposition characteristics of the ink droplets are made stable, and the read accuracy can be improved.

The configuration is one in which a plurality of colors is printed in the same row, and the dots for each color are read from the dots with mixed colors, so the area for printing the test image can be minimized and the conveyance performance can be improved.

By providing a position adjustment device for adjusting the position of the printing medium and test image printing area in which a test image is printed, the deposition characteristics of the ink droplets in the test printing area are ensured, the holding power of the printing medium in the printing medium conveyance area can be increased, and the conveyance performance can be improved. When the test printing area is adjusted to the size of the printing medium with a high frequency of use, the interval between printing media can be reduced and productivity can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
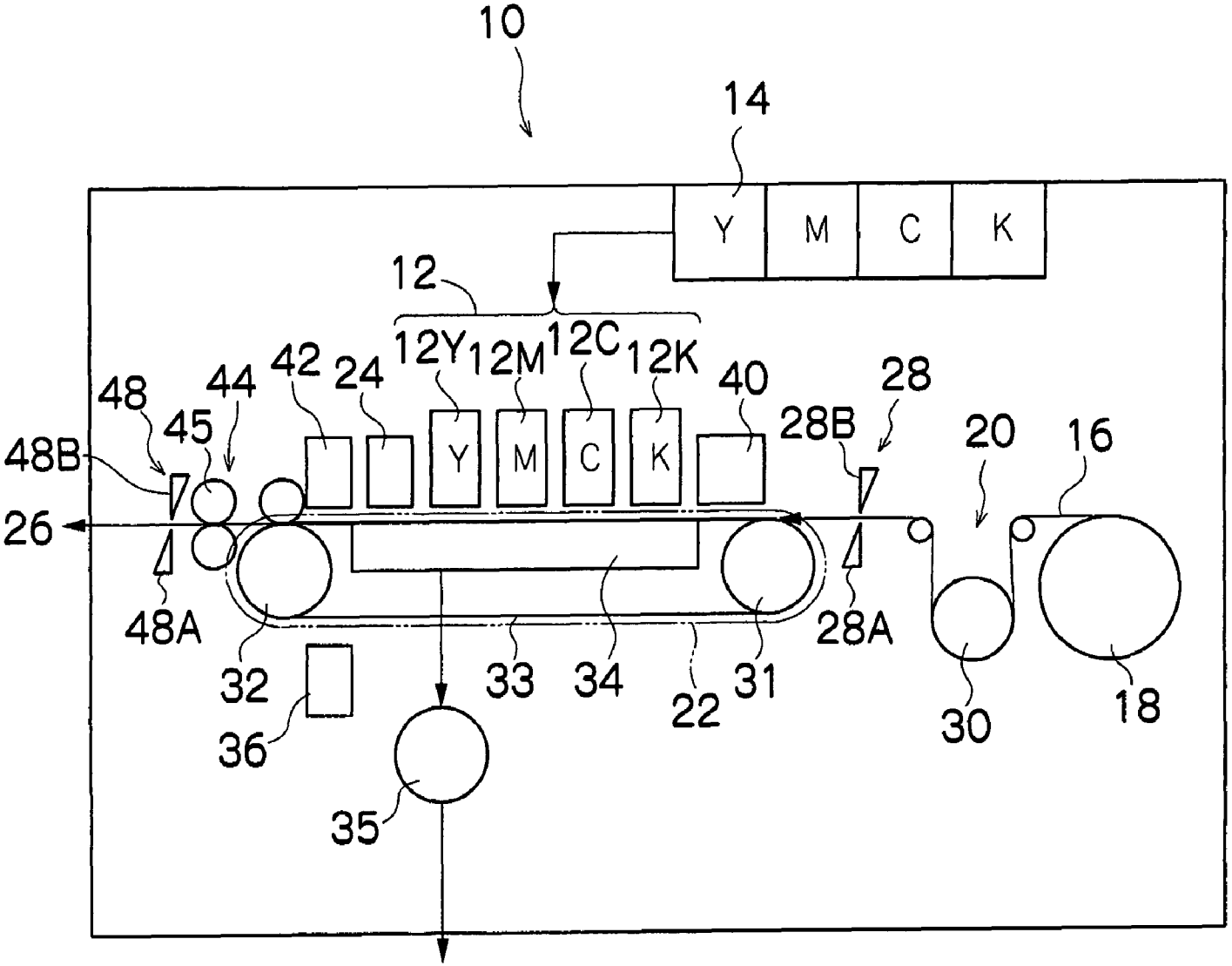
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a line CCD sensor 21 for determining the shape, orientation, and position of the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

Furthermore, the belt 33 is provided with a test print area 33A (not shown in FIG. 1, but shown in FIG. 9) on which a test image is printed. The test image printed on the test print area 33A is read by the print determination unit 24, and discharge defects in the print heads 12K, 12C, 12M, and 12Y are determined from the reading result. The constitution of the belt 33 and the detection of discharge defects in the print heads 12K, 12C, 12M, and 12Y will be described in detail hereinafter.

The belt 33 is driven in the counterclockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from right to left in FIG. 1. The belt 33 is described in detail later.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
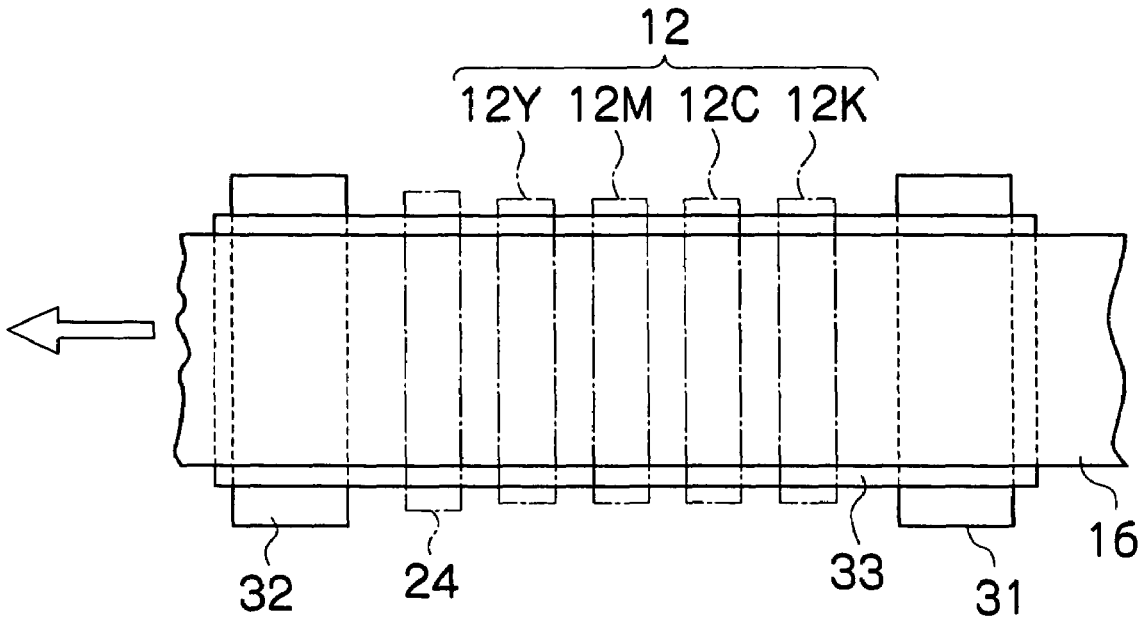
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. Also, the print determination unit 24 is provided with a light source (key symbol 24B in FIG. 9) for directing light to dots formed by deposited droplets.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26 for the target prints.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
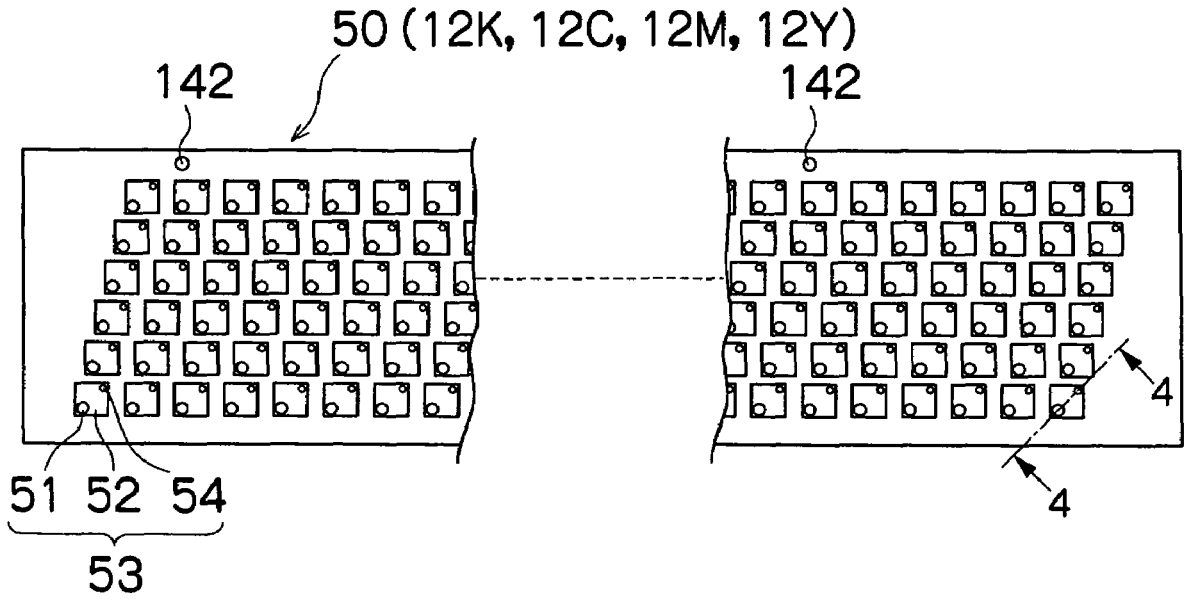
FIG. 3A is a perspective plan view showing an example of a configuration of a print head.
Figure 3B:
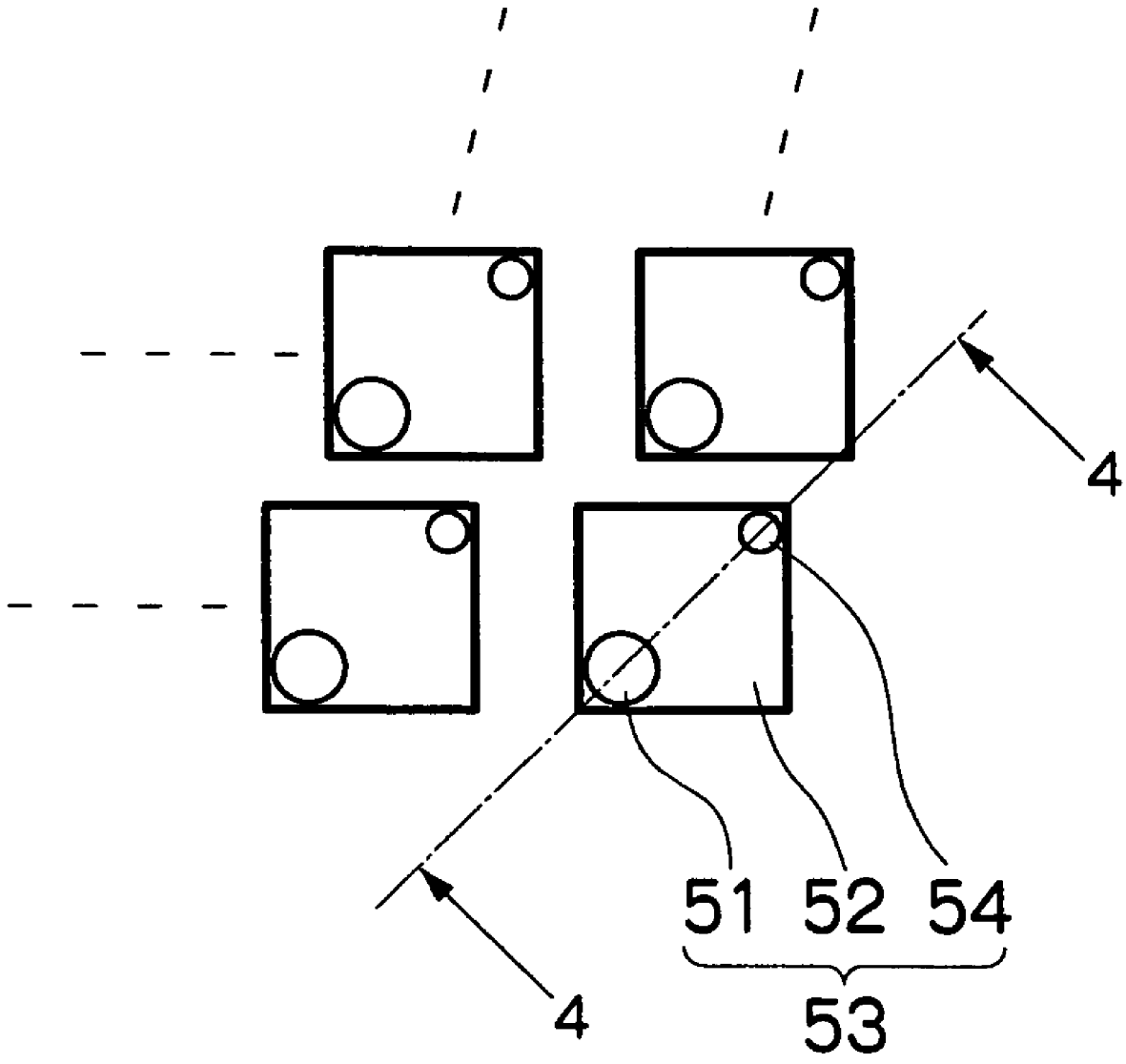
FIG. 3B is a partial enlarged view of FIG. 3A.
Figure 3C:
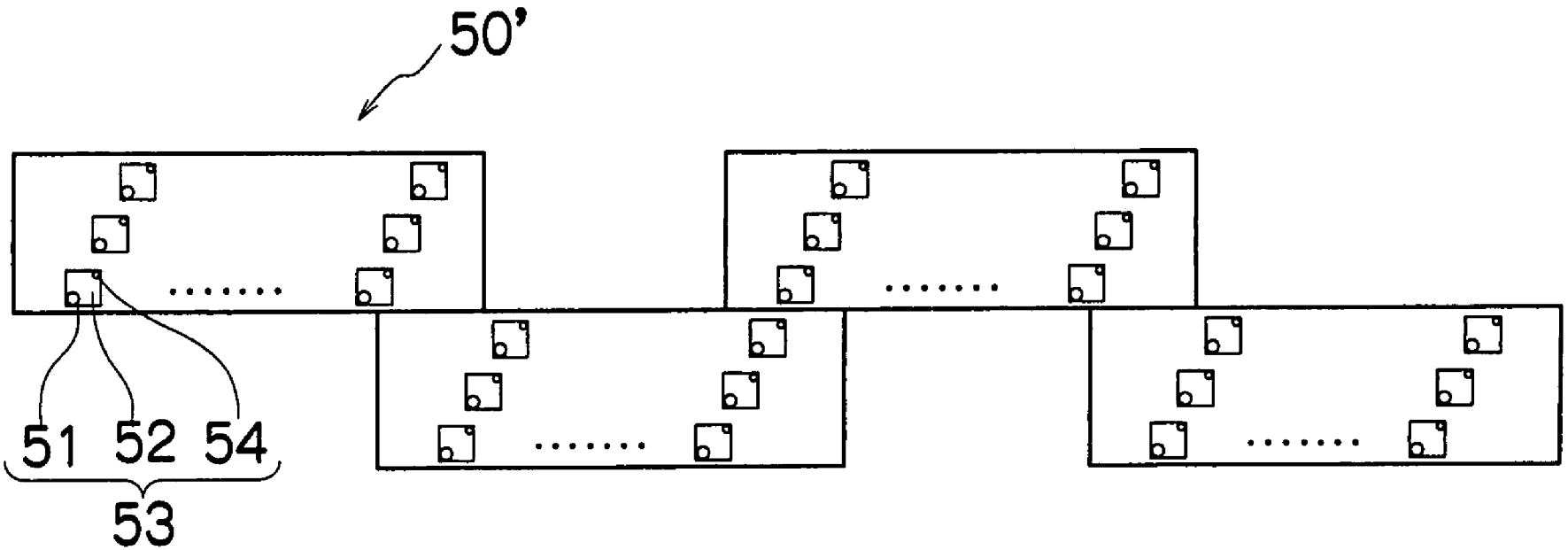
FIG. 3C is a perspective plan view showing another example of the configuration of the print head.
Figure 4:
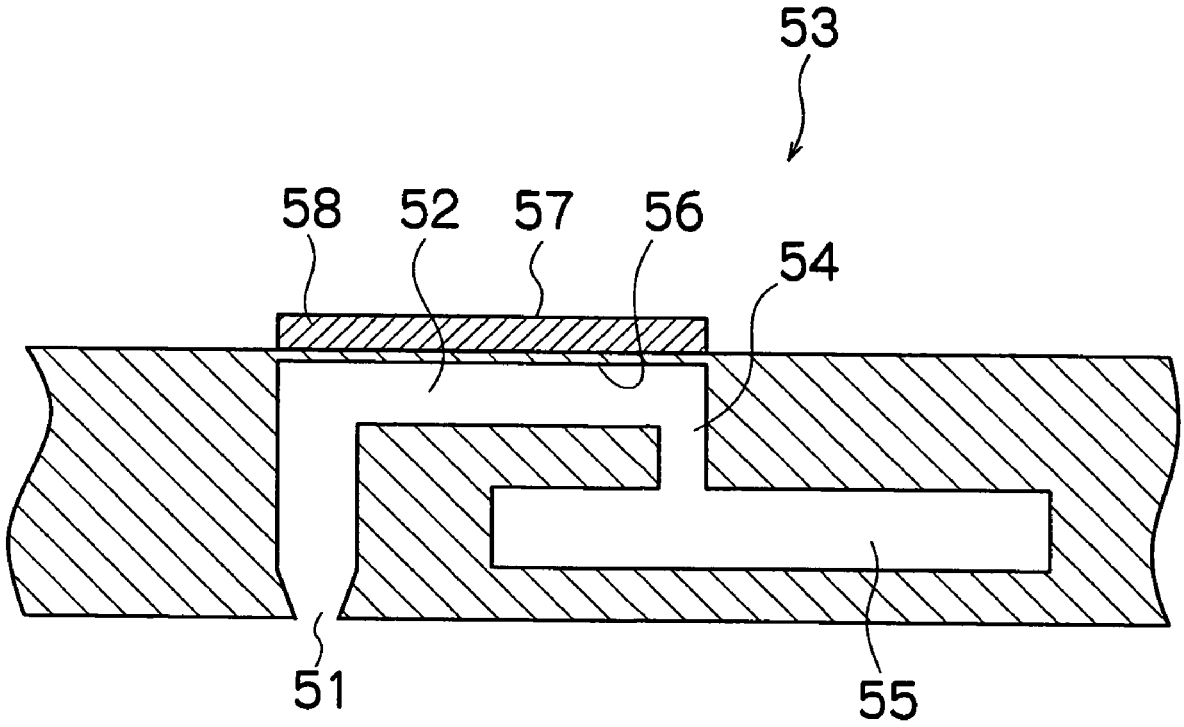
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel 55 through the supply port 54. The common channel 55 is connected to an ink supply tank, which is a base tank that supplies ink, and the ink supplied from the ink tank is delivered through the common flow channel 55 to the pressure chamber 52.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
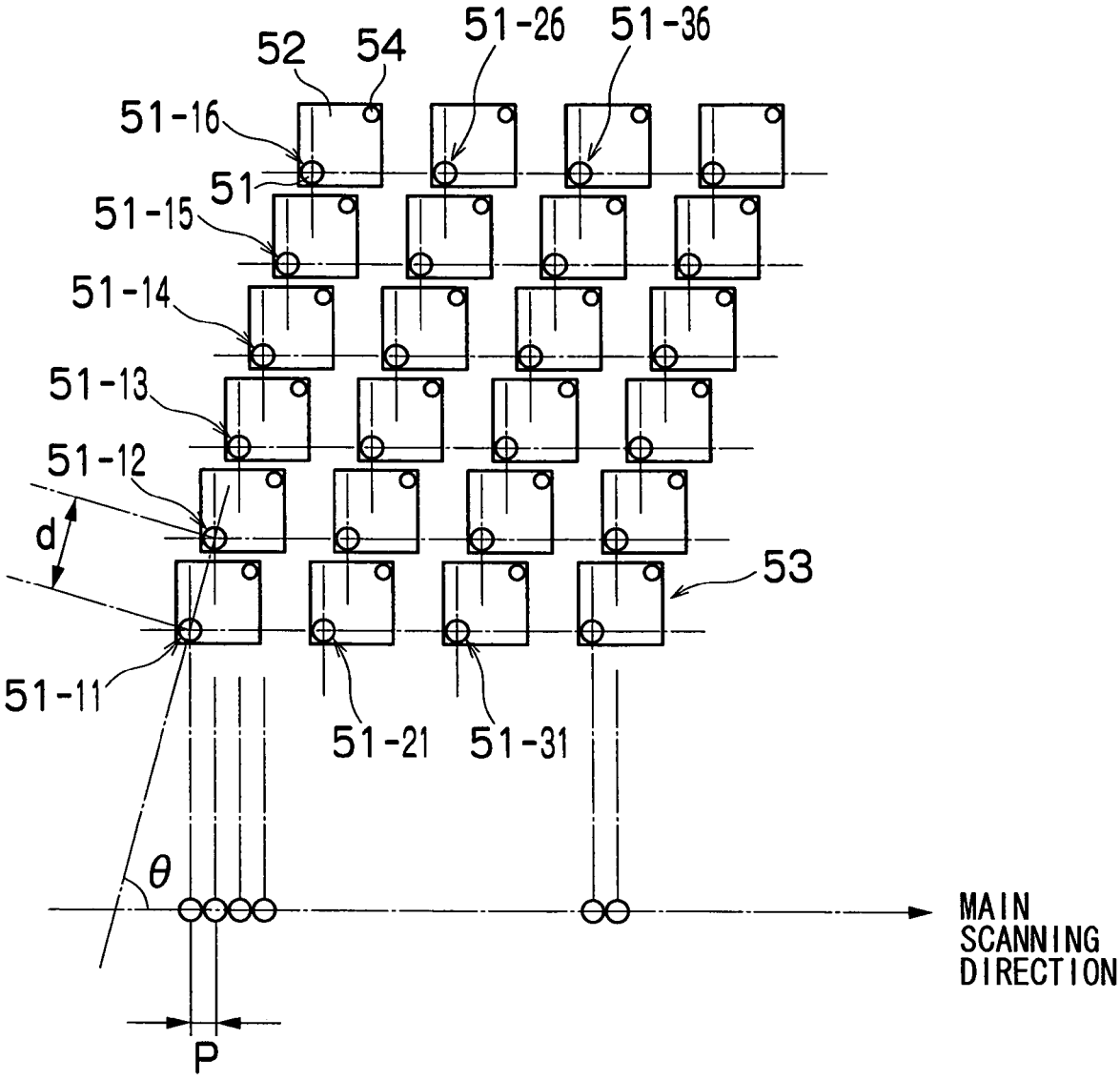
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle arrangement is not particularly limited to the examples shown in the drawings. Also, in the present embodiment, a method that ejects ink droplets by deforming the actuator 58 represented by a piezoelectric element is adopted. In the implementation of the present invention, an actuator other than a piezoelectric element may also be used as the actuator 58.

Figure 6:
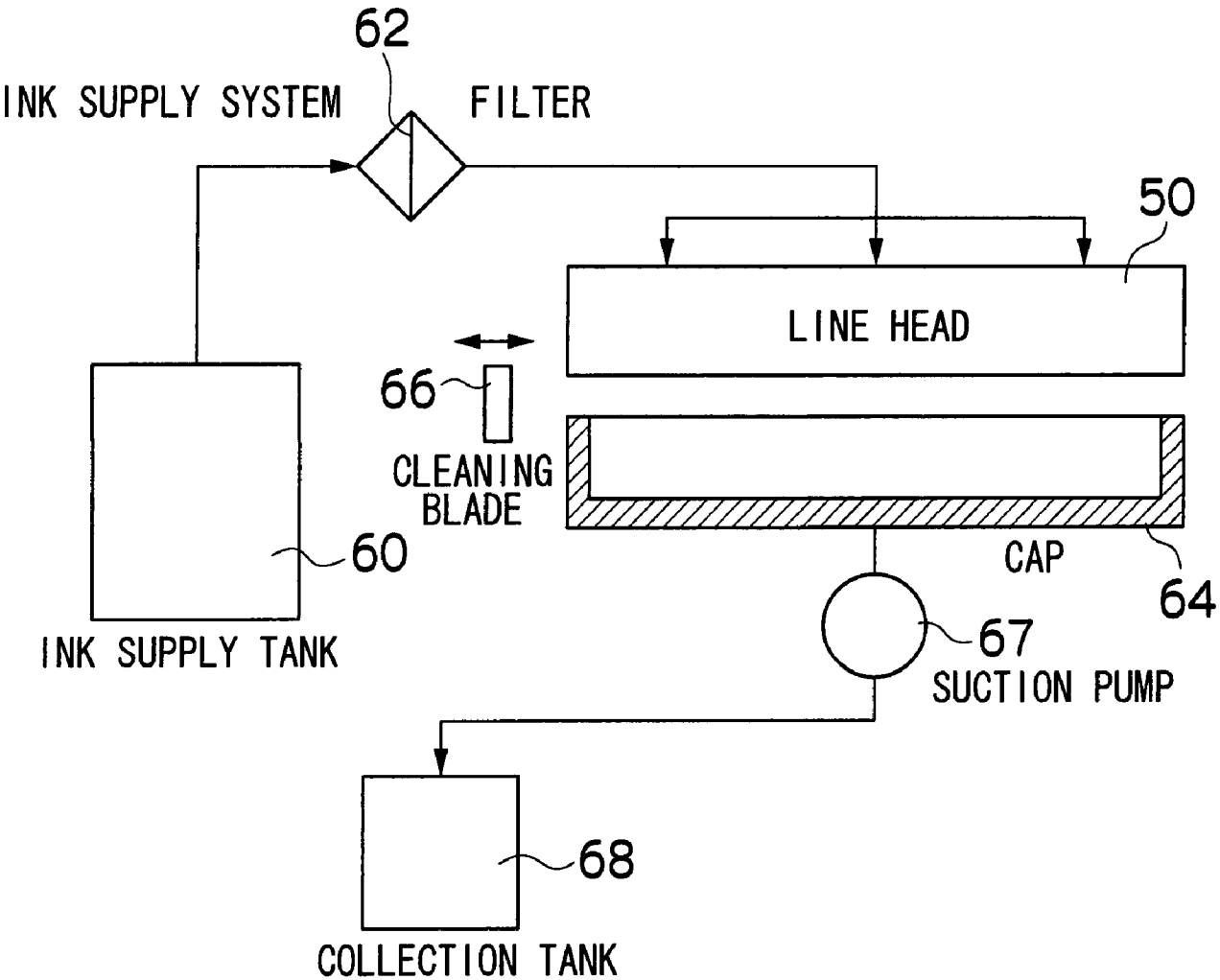
FIG. 6 is a schematic drawing showing a configuration of an ink supply system in the inkjet recording apparatus.

FIG. 6 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzle 51 from drying out or to prevent an increase in the ink viscosity in the vicinity of the nozzles, and a cleaning blade 66 as a device to clean the ink discharge face of the nozzle 51.

A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the ink discharge face of the nozzle 51 is thereby covered with the cap 64.

During printing or standby, when the frequency of use of specific nozzles 51 is reduced and a state in which ink is not discharged continues for a certain amount of time or longer, the ink solvent in the vicinity of the nozzle evaporates and ink viscosity increases. In such a state, ink can no longer be discharged from the nozzle 51 even if the actuator 58 is operated.

Before reaching such a state the actuator 58 is operated (in a viscosity range that allows discharge by the operation of the actuator 58), and a preliminary discharge (purge, air discharge, liquid discharge) is made toward the cap 64 (ink receptor) to which the degraded ink (ink whose viscosity has increased in the vicinity of the nozzle) is to be discharged.

Also, when bubbles have become intermixed in the ink inside the print head 50 (inside the pressure chamber 52), ink can no longer be discharged from the nozzle even if the actuator 58 is operated. The cap 64 is placed on the print head 50 in such a case, ink (ink in which bubbles have become intermixed) inside the pressure chamber 52 is removed by suction with a suction pump 67, and the suction-removed ink is sent to a collection tank 68.

This suction action entails the suctioning of degraded ink whose viscosity has increased (hardened) when initially loaded into the head, or when service has started after a long period of being stopped. The suction action is performed with respect to all the ink in the pressure chamber 52, so the amount of ink consumption is considerable. Therefore, a preferred aspect is one in which a preliminary discharge is performed when the increase in the viscosity of the ink is small.

The cleaning blade 66 is composed of rubber or another elastic member, and can slide on the ink discharge surface (surface of the nozzle plate) of the print head 50 by means of a blade movement mechanism (wiper, not shown). When ink droplets or foreign matter has adhered to the nozzle plate, the surface of the nozzle plate is wiped, and the surface of the nozzle plate is cleaned by sliding the cleaning blade 66 on the nozzle plate. When the unwanted matter on the ink discharge surface is cleaned by the blade mechanism, a preliminary discharge is carried out in order to prevent the foreign matter from becoming mixed inside the nozzles 51 by the blade.

Figure 7:
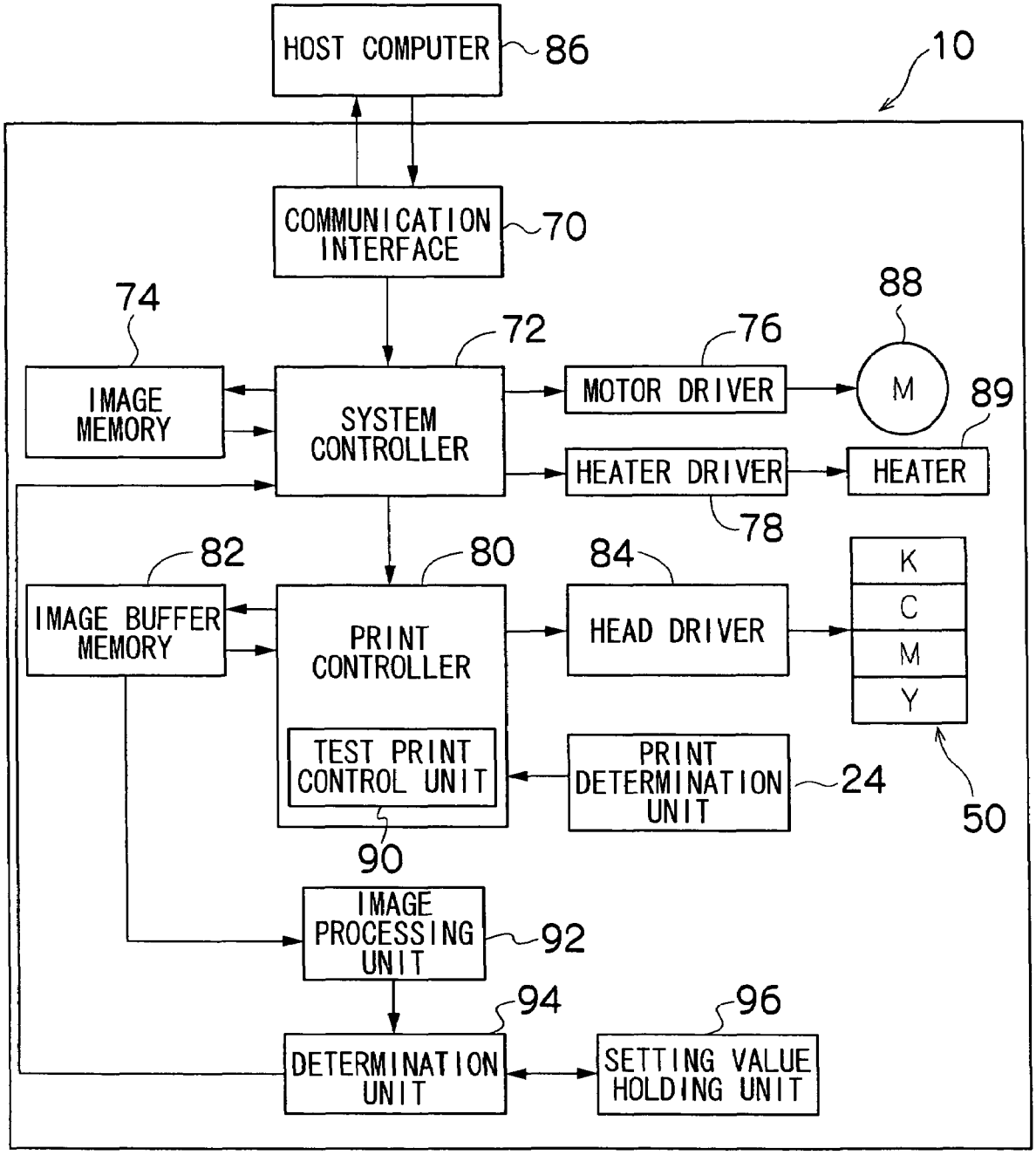
FIG. 7 is a block diagram of principal components showing a system configuration of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

The print controller 80 further comprises a test print controller 90 for controlling the test printing. In the test print controller 90, image (print data) generation (determining the nozzle through which ink is to be discharged during test printing, the ink discharge amount from the nozzle, the discharge position of the ink, and so on) during test printing, discharge signal (the driving signal of the actuator 58 shown in FIG. 4) generation during test printing, and so on are performed.

The test image data read by the print determination unit 24 are first stored in the image buffer memory 82 via the print controller 80, and then transmitted to an image processing unit 92.

In the image processing unit 92, predetermined image processing such as conversion from RGB data to CMY data is implemented on the image read by the print determination unit 24. A determination unit 94 determines whether discharge from each of the nozzles is normal or irregular according to the image-processed test image data while referring to setting values (nozzle management data) of each nozzle recorded in a setting value holding unit 96.

The determination result of the determination unit 94 is transmitted to the system controller 72, whereupon a restorative action such as preliminary discharge or suctioning is implemented on any nozzles determined to be discharge-defective.

Discharge Defect Detection

Next, the detection of discharge-defective nozzles in the inkjet recording apparatus 10 is described.

The inkjet recording apparatus 10 related to the present invention is configured so as to eject ink-droplets to deposit a test pattern to the belt 33 shown in FIG. 1, read the result with the print determination unit 24, and detect discharge-defective nozzles from the read results. Also, the test pattern is deposited to different positions on the belt 33 for each ink color, and reading and detection are carried out for each color.

Figure 8:
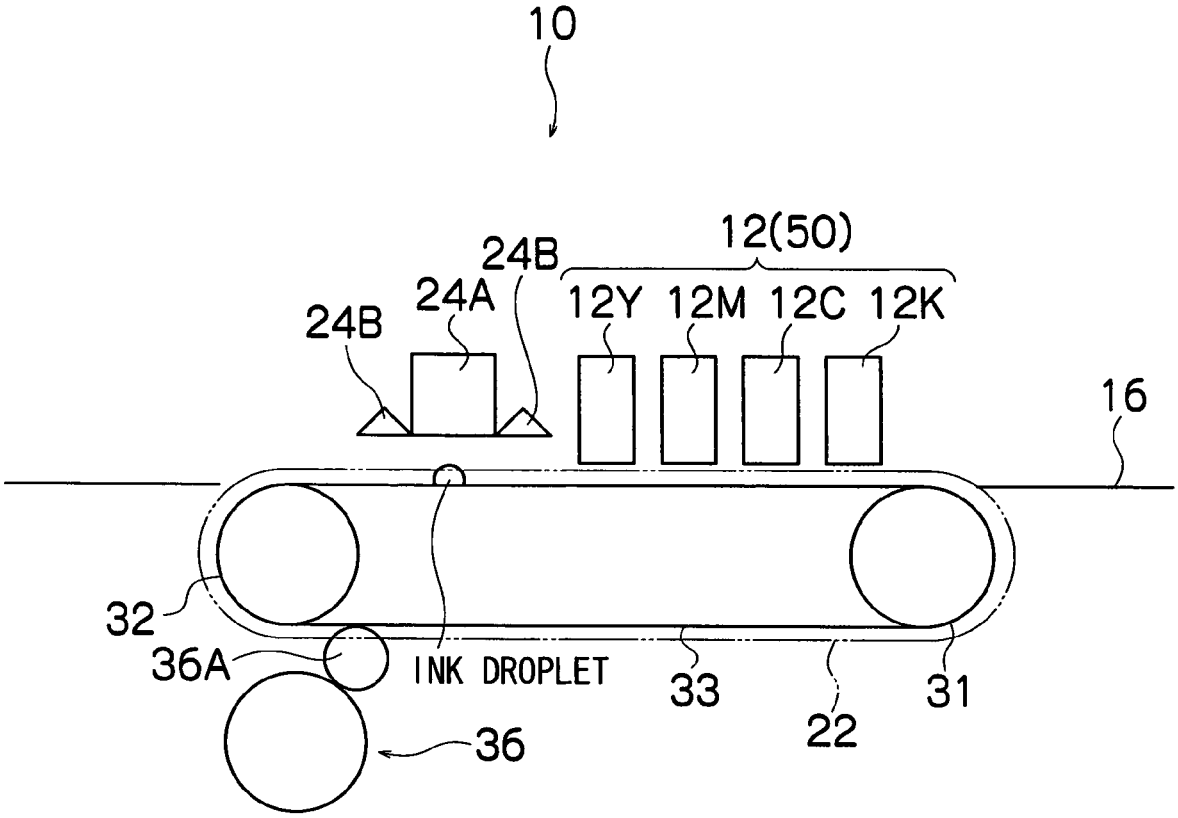
FIG. 8 is a schematic drawing of the portion associated with detecting discharge-defective nozzles.

FIG. 8 is a schematic drawing of the portion associated with detecting discharge-defective nozzles in the inkjet recording apparatus 10. The same key symbols in FIG. 8 are given to the portions that are the same as or similar to those in FIG. 1, and a description thereof is omitted.

The print determination unit 24 has a line sensor 24A and light sources 24B. The configuration is such light is directed from the light source 24B to the test pattern deposited by each of the print heads 50 to the belt 33, and reflected light is read by the line sensor 24A. In the present embodiment, a color resolution line CCD sensor is used as the line sensor, but a line CCD sensor that does not have a color filter may also be used. Furthermore, a laser beam may be shone, the reflected light thereof read, and the shape of the dot acquired.

The belt cleaning unit 36 for cleaning unwanted material from the belt 33 is disposed on the downstream side in the sub-scanning direction of the print determination unit 24, and the belt cleaning unit 36 cleans the belt 33 to which a test pattern has been deposited. The belt cleaning unit 36 may be jointly used as a cleaning member for cleaning excess ink during entire screen printing (printing without margins).

In the present embodiment, a cleaning roll 36A is used as the belt cleaning unit 36, but a blade or another wiping (stripping) member may also be used, and an aspect in which the belt 33 is wetted (sprayed) with solvent and the ink removed is also possible.

The cleaning roll 36A may be in constant contact with the belt 33, or may be in contact only as required. When the cleaning roll 36A is in constant contact with the belt 33, there is little fluctuation in the load, and the conveyance speed is stable. When the cleaning roll 36A is brought into contact in synchronization with discharge, friction with the cleaning roll 36A is prevented.

Figure 9:
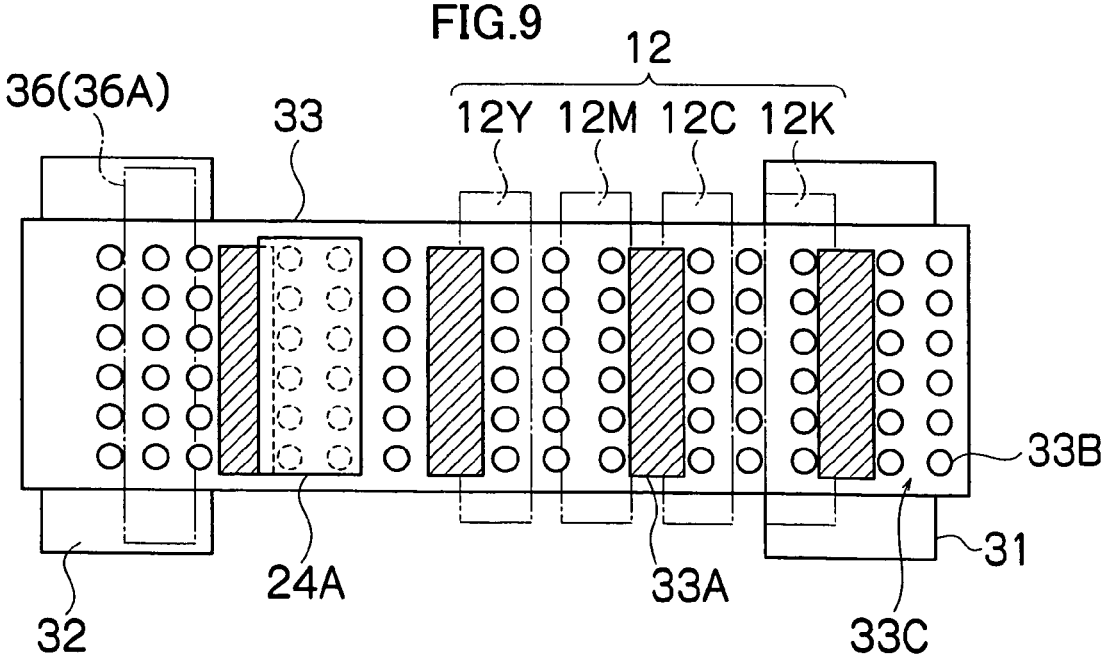
FIG. 9 is a drawing showing the configuration of the belt.

FIG. 9 shows the details of the belt 33. FIG. 9 is a drawing showing the belt from the top direction (upper portion of the print head 50) of FIG. 8.

The belt 33 has a test print area 33A to which a test pattern is deposited, and a recording paper suction area 33C in which a plurality of air suction ports 33B for fixing (air suctioning) the recording paper 16 to the belt 33 is arrayed in the form of a matrix. The test printing area 33A and the recording paper suction area 33C have each a predetermined length in the sub-scanning direction, and are arranged in alternate fashion.

Also, the phase between the test print area 33A and the recording paper suction area 33C is controlled so that the recording paper 16 is carried on the recording paper suction area 33C.

Figure 12:
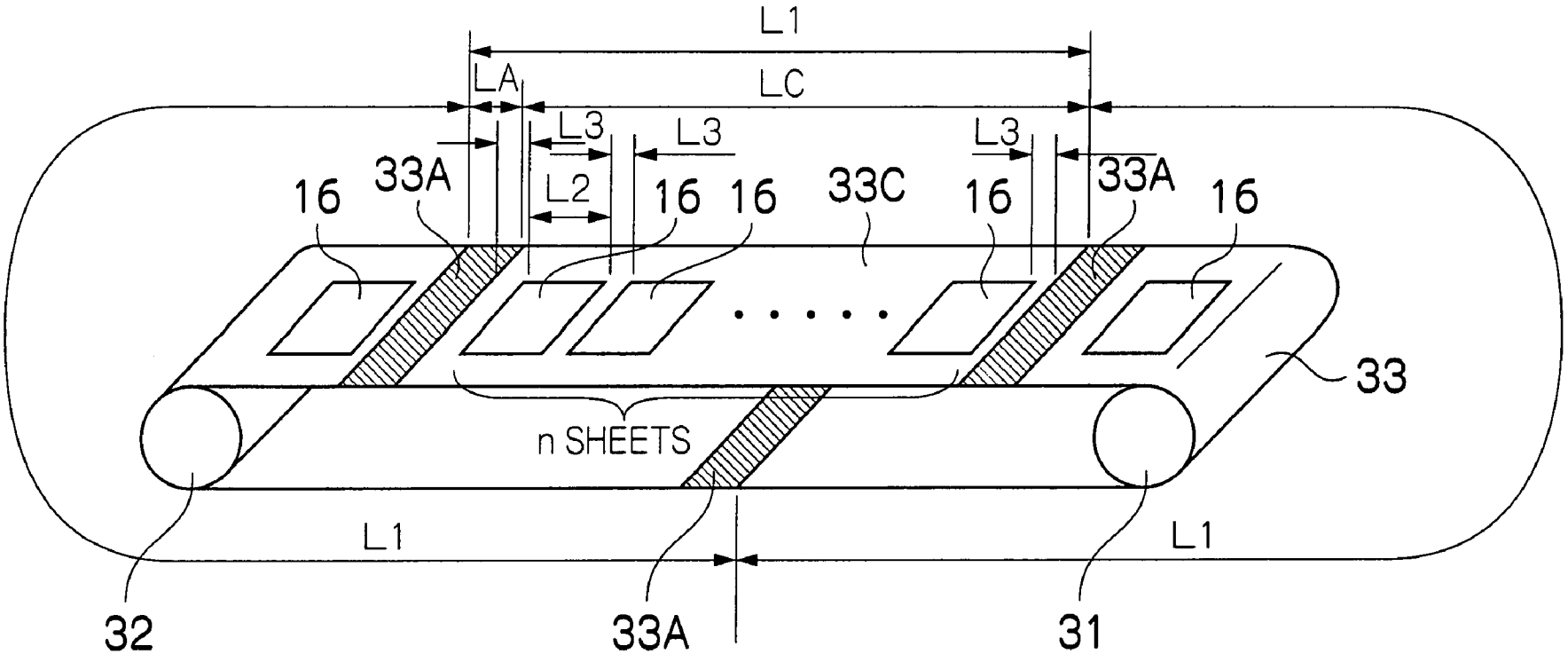
FIG. 12 is a drawing showing the positional relationship of the belt and recording paper.

In other words, as shown in FIG. 12, a length LC along the sub-scanning direction of the recording paper suction area 33C is set in accordance with a size L2 of the recording paper 16 that has a high frequency of use (in the aspect shown in FIG. 12, LC=L2×n, where n is a positive integer), and the test print area 33A having a length LA along the sub-scanning direction is disposed between the recording paper suction area 33C and the next recording paper suction area 33C. When air suction ports 33B are present in the test print area 33A, ink enters into the air suction ports 33B, so air suction ports 33B are not disposed in the test print area 33A.

To put it another way, the test print areas 33A are provided on the belt 33 at a pitch L1 (the sum of the length LA of the test print area 33A along the sub-scanning direction and the length LC of the recording paper suction area along the sub-scanning direction, i.e., L1=LA+LC), and this test print area pitch L1 satisfies a relationship of L1=LA+n×(L2+L3)+L3, where n denotes a positive integer, and L3 denotes the distance between sheets of paper or the distance from the test print area to the adjacent sheet of the paper.

If the air suction ports 33B are provided in the test print area 33A, ink enters the air suction ports 33B, and hence the belt 33 is constituted such that the air suction ports 33B are not disposed in the test print area 33A.

In this example, conveyance control (position alignment control) of the belt 33 is performed to align the position of the belt 33 with the discharge control of the print head 50. A motor that is controllable on the rotational amount, such as a stepping motor or a servo motor, is used as the motor for driving the belt 33 (or the rollers around which the belt 33 is wrapped), and by controlling the rotation of the motor, the position of the belt 33 can be controlled.

The movement of the belt may be calculated by calculating the rotation of the motor from a pulse signal (motor control signal) applied to the motor driver 76 shown in FIG. 7, or a detector such as an encoder or linear encoder may be provided in the motor or belt 33 so that the rotation of the motor or the movement of the belt 33 is calculated from a detection pulse (detection signal) obtained from the detector.

When the recording paper suction area 33C is adjusted to the size of the recording paper 16 that has a high frequency of use, test printing is possible between the images being printed and productivity is not lost. Furthermore, when the recording paper suction area 33C is set to the lowest common multiple between the size of the recording paper with the highest frequency of use and the size of the recording paper 16 with the next highest frequency of use, different sizes of recording paper 16 can be favorably used with good efficiency.

A polyimide or another plastic material may be used as the material for the belt 33, or a metal may be used. Also, various other materials may be used. However, the planarity of the recording paper 16 suctioned to the belt 33 must be ensured. Also, a material that has adequate deposition (fixing) characteristics for the ink droplets and that is easily cleaned by the belt cleaning unit 36 is used for the test print area 33A. Of course, a preferable aspect is one in which the entire belt 33, including the recording paper suction area 33C, is composed of a material having the above performance.

Figure 13:
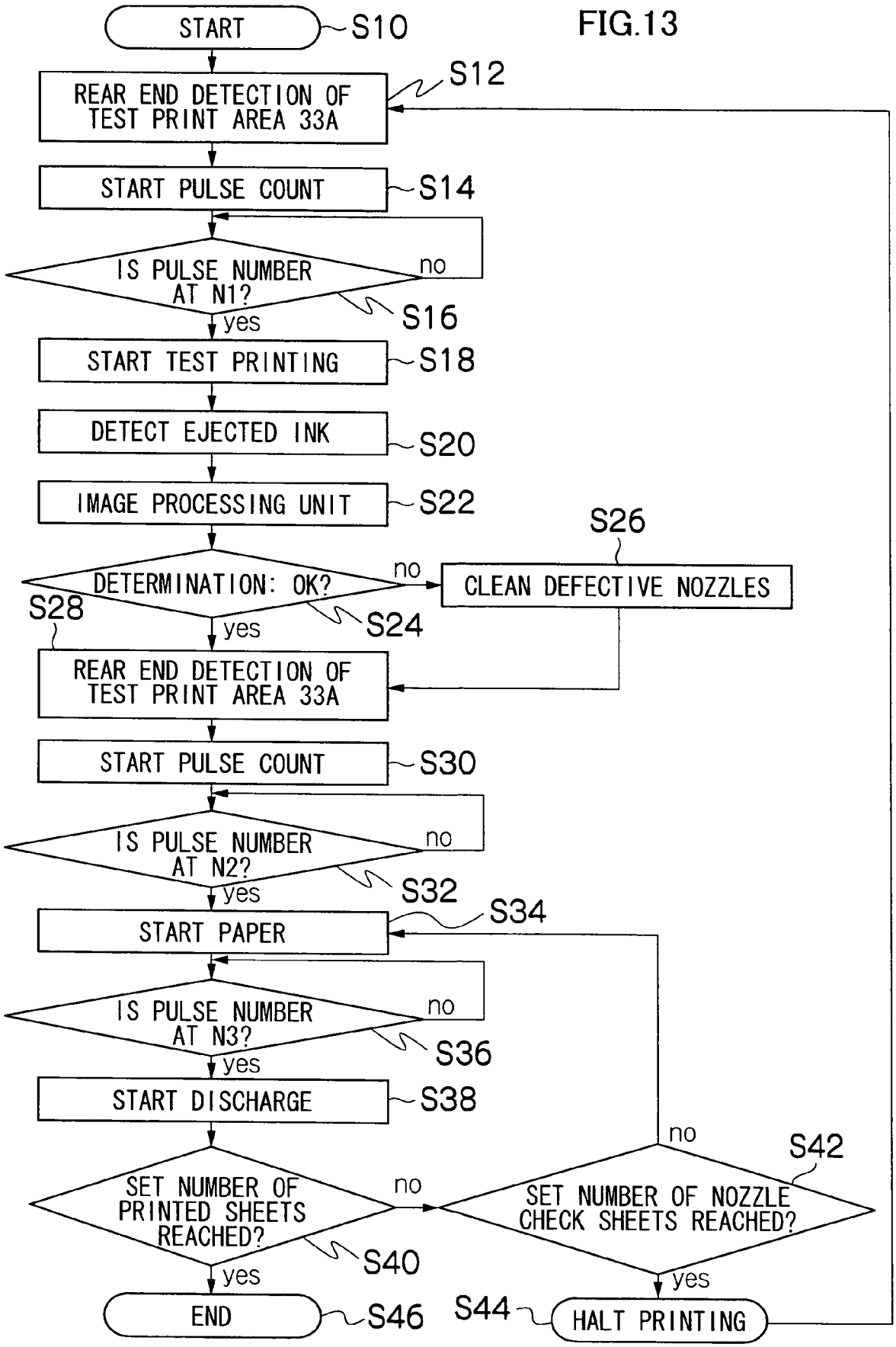
FIG. 13 is a flowchart showing the flow of control for detecting discharge defects.

FIG. 13 is a flowchart showing the flow of the test print control described above.

When test print control begins (step S10), detection of the rear end of the test print area 33A (the downstream end in the advancement direction of the belt 33) is performed by the print determination unit 24 (step S12), after which counting of the pulse signal applied to the motor driver (the motor driver 76 shown in FIG. 7) of the motor which drives the belt 33 is begun (step S14) using the rear end of the test print area 33A as a reference (origin). The routine then advances to step S16.

In step S16, a determination is made as to whether or not the pulse count (pulse number) has reached N1. When the pulse count is not N1 (i.e., smaller than N1) (a NO determination), pulse counting is continued.

When the pulse count reaches N1, test printing begins (step S18).

Here, the pulse number N1 corresponds to movement of the belt 33 from a state in which the rear end of the test print area 33A is positioned in the detection area of the print determination unit 24 to a state in which the front end of the next test print area 33A has moved to the print area of the print head 50. Thus, the pulse number N1 corresponds to the length of the recording paper suction area 33C.

When test printing is executed, the test image is read in the print determination unit 24 (step S20). After predetermined image processing is implemented on the reading result (step S22), a determination is made as to whether or not any nozzles are discharge-defective (step S24).

On nozzles that are determined to be discharge-defective in step S24, restorative processing (cleaning) such as preliminary discharge or suctioning is implemented (step S26), and the routine then advances to step S28, where rear end detection of the next test print area 33A is performed. On the other hand, on the nozzles determined to be normal and not discharge-defective in step S24, the routine advances to step S28, where rear end detection of the next test print area 33A is performed.

When the rear end of the next test print area 33A is detected in step S28, the next pulse count begins (step S30), and a determination is made as to whether or not the pulse count has reached N2 (step S32).

The pulse number N2 may correspond to movement of the belt 33 from a state in which the rear end of the test print area 33A is positioned in the detection area of the print determination unit 24 to a state in which the front end of the recording paper 16 has moved to the print area of the print head 50.

When the pulse count is not N2 (the pulse count is lower than N2) in step S32 (a NO determination), pulse counting is continued, and when the pulse count reaches N2, conveyance control of the belt 33 is performed (step S34) such that conveyance of the recording paper 16 is begun. The routine then advances to step S36.

Control may be performed during pulse counting to halt the recording paper 16 temporarily using a resist sensor (not shown) provided at the front of the belt, and to begin conveying the recording paper 16 when the pulse count reaches N2.

In step S36, a determination is made as to whether or not the pulse count has reached N3. If the pulse count has not reached N3 (the pulse count is lower than N3) (a NO determination), pulse counting is continued, and when the pulse count reaches N3 (a YES determination), ink discharge (actual image printing) from the print head 50 is begun (step S38).

After actual image printing is begun, a determination is made as to whether or not the number of printed sheets has reached a set number (step S40). If the number of printed sheets is less than the set number (a NO determination), the routine advances to step S42, where a determination is made as to whether or not the number of printed sheets has reached a set number of nozzle check sheets.

If the number of printed sheets is less than the set number of nozzle check sheets in step S42 (a NO determination), the routine returns to step S34, where printing is continued.

When the number of printed sheets reaches the nozzle check number at step S42, printing is halted (step S44), and the routine returns to step S12, where rear end detection of the test print area 33A is performed.

If the number of printed sheets has reached the set number in step S40 (a YES determination), printing control ends (step S46).

The pulse numbers N1, N2, N3 are preferably determined in consideration of the reading tolerance of the print determination unit 24 and the conveyance tolerance of the belt 33.

When a water-repellent ink material with a low affinity with the ink is used, the droplets deposited onto the belt 33 do not adhere and may move around. Also, when the affinity with the ink is high, the droplets are more readily fixed onto the belt 33, but the deposition diameter is greater, and coalescence may take place with other ink droplets deposited nearby.

Figure 10:
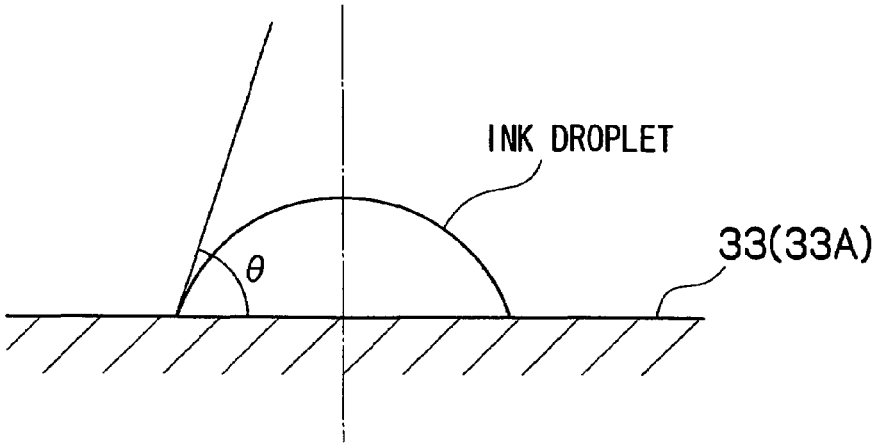
FIG. 10 is a drawing showing the contact angle.

In the present embodiment, the contact angle of the ink droplets is used as the physical property that shows the relative affinity between the ink droplets and the belt 33. The contact angle θ of an ink droplet is expressed as the angle that is formed by the deposition surface and the tangent line to the ink droplet at the deposition surface, as shown in FIG. 10. When the contact angle is considerable the affinity is low (the fixing property of the ink droplets is low), and when the contact angle is small the affinity is high (the fixing property of the ink droplets is high).

The condition in which the ink droplets have completely soaked the belt 33 is referred to as a contact angle of 0°, and the condition in which the ink droplets and the deposition surface make contact at a single point is referred to as a contact angle of 180°. Also, the surface roughness and other surface characteristics of the belt 33 are related to the fixing property of the ink droplets, so when the test print area 33A is a metal, it is possible to roughen the surface to obtain a desired contact angle.

When the contact angle is about 90° the ink droplets are easy to read, and a preferable material for the test print area 33A is one for which the contact angle of the ink droplets is 40° or more. A material for which the contact angle is 100° or more is even more preferable.

Also, in order to make the deposited test pattern easily recognizable, the test print area 33A is configured so that a difference in brightness is set up between the ink colors. It is apparent that different colors than the ink colors may be used. Furthermore, a transparent (semitransparent) material is used as the test print area 33A, and the line sensor 24A is disposed in a position facing the print head 50 across the interposed the belt 33, and it is possible to read the test pattern with the transmitted light. Performing a read operation in transmitted light can increase the reading accuracy in comparison with performing a read operation in reflected light.

In the present embodiment, the material and physical properties of the test print area 33A are exemplified, but also possible is a configuration in which the entire belt 33 is the same material as the test print area 33A.

In the present embodiment, an aspect is exemplified in which the recording paper 16 is fixed in place (suctioned) to the belt 33 with air, but the recording paper 16 may be fixed in place on the belt 33 with electrostatic force or the like. When electrostatic force is used to fix the recording paper 16 in place, air suction ports 33B are not required, and the test print area 33A and the recording paper suction area 33C do not need to be differentiated. That is to say, test printing can be performed to all areas of the belt 33, and the recording paper 16 can be caused to adhere to all areas.

When the print head 50 is made longer and is extended in the conveyance direction of the printing paper 16, there is a marked positional displacement of the nozzles on the upstream and downstream sides. Conveyance by suction or by winding on the belt is performed with consideration given to skew and other factors.

When the configuration is such that the print head 50 is placed on standby and a sheet of test print paper is sent through, the productivity is affected, but in the present embodiment test printing is performed without sending test print paper through, so the print head 50 is not required to be placed on standby.

In the case that a mechanism is provided for placing the print head 50 on standby in the reverse direction (the upper portion of the print head) of the belt 33, the read accuracy can be increased when this fact is used and the distance is increased between the print head 50 and the belt 33. When the print determination unit 24 is integrally formed, the distance between the line sensor 24A and the belt 33 (test print area 33A) is about 1 mm or less. In order to ensure a predetermined reading accuracy, the distance between the line sensor 24A and the belt 33 should be increased.

When the nozzles become highly integrated, the distance between the dots grows smaller in association therewith. When the distance between the dots becomes smaller, the ink droplets tend to coagulate on the belt 33, so it is preferable to perform discharge with an interval provided between depositions.

Figure 11:
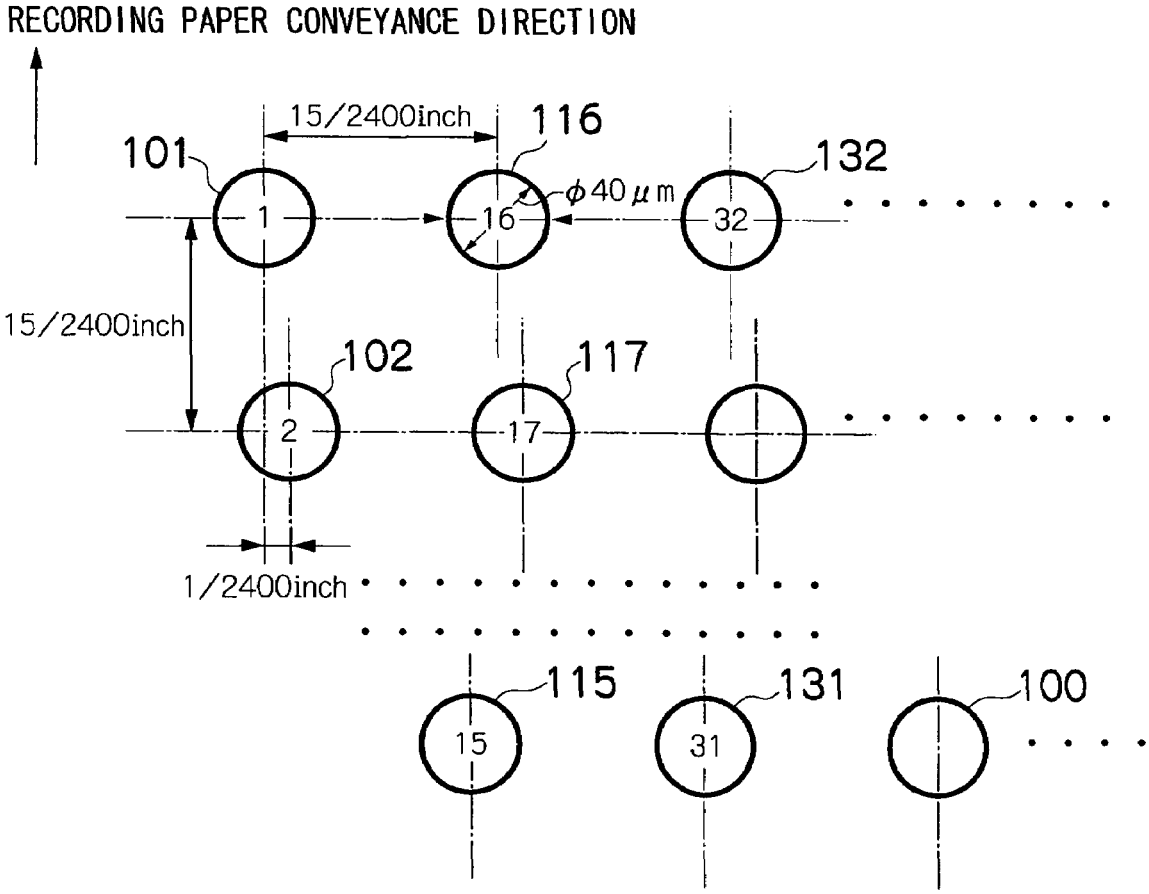
FIG. 11 is a drawing describing an example of a test pattern.

FIG. 11 shows an example of the test pattern deposition in the present embodiment. The conditions of the present example are as follows: a print head 50 resolution of 2,400 dpi, an ink droplet contact angle of 40°, and an ink droplet discharge amount of 10 picoliters. The deposition diameter of the dots deposited under these conditions is between 30 μm and 40 μm.

The numbers inside the dots (key symbols 100 to 131) shown in FIG. 11 indicate the number of the nozzle by which the dot is deposited, and show the array order of nozzle rows projected so that the nozzle rows inside the print head 50 align in the main scanning direction. In other words, in the projected nozzle rows, the first nozzle, second nozzle, . . . , 15th nozzle, 16th nozzle, and so forth are aligned in order from the left in FIG. 11.

Dot 116 deposited by the 16th nozzle is disposed in a position next to the dot 101 deposited by the first nozzle in the main scanning direction. As follows in this example, dot 132 is deposited by the 32th nozzle, dot 148 (not depicted) is deposited by the 48th nozzle, and so forth. The dot interval (dot pitch) in each of the dot rows along the main scanning direction is $^{15}/_{2400}$ inch.

On the other hand, the dot 102 deposited by the second nozzle is disposed with an interval of $^{15}/_{2400}$ from the dot 101 in the sub-scanning direction. The interval in the main scanning direction between the dots 101 and 102 is $^{1}/_{2400}$ inch. As follows, each dot is disposed with a deposition interval of $^{15}/_{2400}$ inch in the sub-scanning direction, and $^{1}/_{2400}$ inch in the main scanning direction in the following sequence: dot 103 deposited by the third nozzle, . . . , and dot 115 deposited by the 15th nozzle.

When a test pattern is deposited as described above for each dot, the center distance between the closest dots is $^{15}/_{2400}$ inch, in other words, about 160 μm. When the nozzles are properly discharging ink droplets, ink coalescence cannot occur even considering the variability in the nozzles and the like.

The test pattern data read by the print determination unit 24 is sent to the print controller 80 shown in FIG. 7, and thereafter stored in a temporary image buffer memory 82 (storage unit). Predetermined image processing is performed for each ink color by an image processing unit (not depicted) from this test pattern data. In this image processing, the contour of each dot is extracted, and the diameter of each dot and the distance (center distance) between each dot are calculated. The information for each dot obtained in such a manner and the information for the dots that are originally to be ejected are compared, and nozzle non-discharge, abnormal discharge amount, abnormal discharge direction (abnormal flight direction of the ink droplets), and other discharge defects are detected.

When a discharge-defective nozzle is detected, ejection correction (image correction) is performed with respect to the next print job. In image correction, substitute ejection from nozzles adjacent to the discharge-defective nozzles is carried out. Possible aspects for substitute ejection include an aspect in which ink droplets with a larger size than a predetermined size are ejected from nozzles that are adjacent to the discharge-defective nozzles, and an aspect in which the discharge direction of the ink droplets of the adjacent nozzles is offset to compensate for the discharge-defective nozzles.

Also, instead of the above image correction, control may be carried out so as to perform restorative actions with respect to the discharge-defective nozzles. Restorative actions include suctioning action for forcefully suctioning discharge-defective nozzles, and performing purging whereby a preliminary discharge (liquid discharge) is directed to the cap 64 shown in FIG. 6. The restorative actions may be selectively performed in accordance with the conditions of the nozzles. It is, of course, also possible to use a plurality of restorative actions in combination.

In the present embodiment an aspect is exemplified in which a test pattern is a printed for each color, but it is also possible to detect discharge-defective nozzles inside the print head 50 corresponding to each color from a single dot composed of a plurality of colors by discharging a plurality of inks with different colors other than black to the same deposition point, and differentiating the color information.

Figure 14:
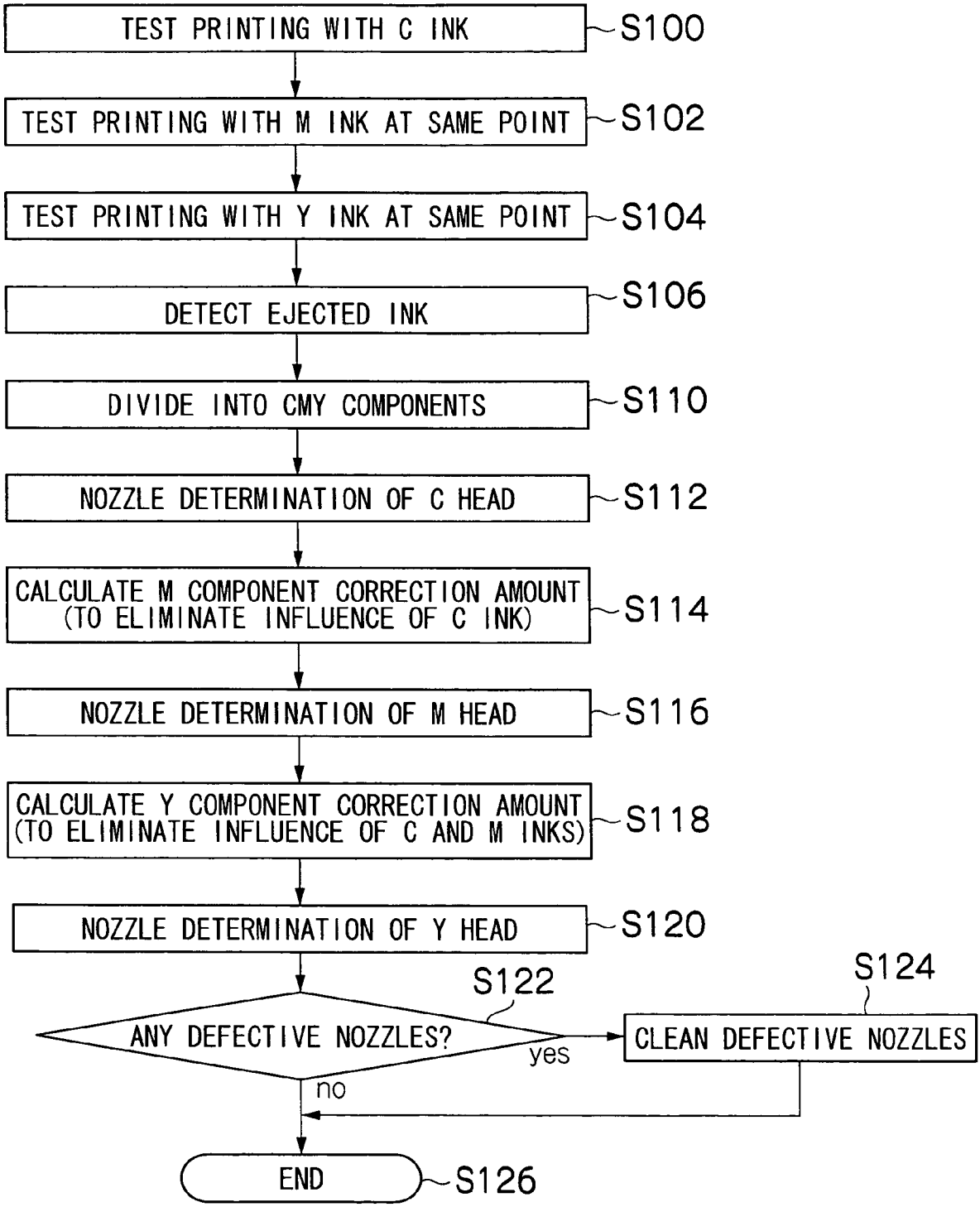
FIG. 14 is a flowchart showing the flow of control in an application of the discharge defect control shown in FIG. 13.

Next, an example of the method for reading dot information for each color from dots composed of a plurality of colors other than black is described with reference to FIG. 14. The dots composed of a plurality of colors are read with a line sensor for a plurality of colors (RGB), and processing is performed in the following ink order.

First, test printing is performed using C ink (step S100), and then test printing is performed using M ink on the same point (step S102). Test printing is then performed using Y ink on the same point (step S104), whereupon test print reading is performed by the print determination unit 24 (step S106).

The test print read by the print determination unit 24 is divided into its CMY components (step S110), whereupon detection of each of the CMY colors is performed according to the following procedures.

(Processing procedure 1) First, defective nozzles are detected for C ink nozzles (step S112). The output of the R sensors is used in the evaluation of the C ink nozzles.

(Processing procedure 2) The correction amount of the M component is calculated to eliminate the influence of the C ink (step S114).

(Processing procedure 3) Next, defective nozzles are detected for M ink nozzles (step S116), taking into account the amount of M component correction. The output from the G sensors is used in the evaluation of the M ink nozzles. Defective locations in the C ink nozzles are eliminated, and detection and correction are performed in other ranges.

(Processing procedure 4) The correction amount of the Y component is calculated to eliminate the influence of the C ink and M ink (step S1118).

(Processing procedure 5) Next, defective nozzles are detected for Y ink nozzles (step S120), taking into account the amount of Y component correction. The output from the B sensors is used in the evaluation of the Y ink nozzles. Defective locations in the C ink nozzles and M ink nozzles are eliminated, and detection and correction are performed in other ranges.

The reason processing is performed in the order of C→M→Y in accordance with the above processing procedures 1 to 5 is because of the relationship between the spectral sensitivity of the sensors and the optical absorption of the coloring material. In other words, K ink gives an output variation that is substantially the same as each of the sensors RGB. Therefore, accurate detection is possible by performing initial processing using the average value of these. Also, the coloring material normally has sub-absorption on the short wavelength side, so C ink has absorption in the R area, and the absorption also occurs on the shorter wavelength side, that is, in the G and B areas. In other words, C ink affects the determination of M ink and Y ink. In a similar fashion, M ink affects the determination of Y ink. It is therefore preferable to perform processing in a sequence with a wide range of effects (in other words, in order from the long wavelength side) in order to eliminate such effects. Processing between colors can thereby be efficiently carried out.

Next, in step S122, a determination is made as to whether any of the nozzles are discharge-defective. On the nozzles determined to be discharge-defective in step S122 (a YES determination), restorative processing (cleaning) such as preliminary discharge or suctioning is implemented (step S124), whereupon the routine advances to step S126 and discharge defect detection ends. On the other hand, on the nozzles determined to be normal in step S122 (a NO determination), discharge defect detection ends (step S126).

When the dot information can be read for each color from a single dot composed of a plurality of colors in this manner, the time spent on reading and detecting can be reduced and the length along the sub-scanning direction of the test printing area 33A can be made shorter.

In the inkjet recording apparatus 10 configured as described above, a test printing area 33A is provided to the belt 33 for conveying the recording paper 16, a test pattern is printed to the test printing area 33A, the printed result is read by the print determination unit 24, and the discharge-defective nozzles are detected from the read results, so defective nozzles can be detected, and improved image quality can be ensured through restorative action to the nozzles and/or through substitution with other nozzles. Recording paper 16 for test printing is furthermore not wasted.

A configuration is adopted whereby the print determination unit 24 can be set in place and the deposited ink can be read, so the print head 50 is not required to be placed on standby, and improved productivity can be expected. Furthermore, discharge defects can be detected using the gap between papers, and detection can be performed without loss of productivity during printing as well.

Also, a long head does not need to be placed on standby, and the structure can be simplified, contributing to lower costs.

An ink jet recording apparatus with a full-line print head is exemplified in the present embodiment, but the scope of application of the present invention is not limited to this, and it is also possible to use a shuttle-scan inkjet recording apparatus.

A piezo-type inkjet recording apparatus is exemplified in the present embodiment, but the scope of application of the present invention is not limited to this option alone, and application can be made to bubble-type inkjet recording apparatuses that discharge ink with bubbles generated by rapidly heated ink.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a print head which discharges ink droplets;

a conveyance device which relatively moves a printing medium in a printing medium conveyance direction with respect to the print head, the conveyance device having a holding conveyance member which holds the printing medium and conveys the printing medium, the holding conveyance member having a plurality of first predetermined areas having holding means to hold the printing medium and a plurality of second predetermined areas having no holding means to hold the printing medium, each second predetermined area being disposed between a respective two of the plurality of first predetermined areas, and wherein the plurality of second predetermined areas are disposed with an interval matched to a size of the printing medium that has a high frequency of use in the printing medium conveyance direction;

a test printing control device which controls printing of a test image to the holding conveyance member; and a reading device which reads the test image printed on the holding conveyance member with the test printing control device, wherein the test printing control device performs control for printing the test image in the plurality of second predetermined areas.

2. The inkjet recording apparatus as defined in claim 1, wherein the holding conveyance member comprises a position adjustment device which relatively adjusts positions of a plurality of printing media that are continuously conveyed by the conveyance device and the second predetermined areas for printing the test image so that the second predetermined areas for printing the test image are disposed between the plurality of printing media.

3. The inkjet recording apparatus as defined in claim 1, wherein at least the plurality of second predetermined areas of the holding conveyance member for printing the test image have a color whereby an ink color is easily determined.

4. The inkjet recording apparatus as defined in claim 1, wherein at least the plurality of second predetermined areas of the holding conveyance member for printing the test image are composed of a material in which deposition characteristics of the ink droplets are stable.

5. The inkjet recording apparatus as defined in claim 1, wherein the test printing control device performs control so that the test image is printed in an area between actual images.

6. The inkjet recording apparatus as defined in claim 1, further comprising a detection device which detects a discharge-defective nozzle according to the test image read by the reading device.

7. The inkjet recording apparatus as defined in claim 1, further comprising a cleaning device which cleans the holding conveyance member, the cleaning device being disposed on a downstream side of the reading device in the printing medium conveyance direction.

8. The inkjet recording apparatus as defined in claim 1, wherein:

the test printing control device performs control to deposit the ink droplets of a plurality of colors to the same deposition point to make a mixed-color dot composed of the plurality of colors; and the reading device reads dot information for each color from the mixed-color dot.

9. A method which detects a discharge defect in an inkjet recording apparatus comprising a print head which discharges ink droplets, and a conveyance device which relatively moves a printing medium in a printing medium conveyance direction with respect to the print head, the conveyance device having a holding conveyance member which holds the printing medium and conveys the printing medium, the holding conveyance member having a plurality of first predetermined areas having holding means to hold the printing medium and a plurality of second predetermined areas having no holding means to hold the printing medium, each second predetermined area being disposed between a respective two of the plurality of first predetermined areas, and wherein the plurality of second predetermined areas are disposed with an interval matched to a size of the printing medium that has a high frequency of use in the printing medium conveyance direction, the method comprising:

a test printing step of printing a test image to the plurality of second predetermined areas on the holding conveyance member from the print head;

a reading step of reading with a reading device the test image deposited to the holding conveyance member in the test printing step; and a detection step of detecting a discharge-defective nozzle according to the test image read in the reading step.

* * * * *